US011440048B2

(12) United States Patent
Robinson

(10) Patent No.: US 11,440,048 B2
(45) Date of Patent: Sep. 13, 2022

(54) FORMATION OF SPECIALIZED COATINGS ON PRODUCTS BASED UPON SELF-DIFFERENTIATING SLURRIES OR LIQUIDS

(71) Applicant: Kevin Cyrus Robinson, Lutz, FL (US)

(72) Inventor: Kevin Cyrus Robinson, Lutz, FL (US)

( * ) Notice: Subject to any disclaimer, the term of this patent is extended or adjusted under 35 U.S.C. 154(b) by 10 days.

(21) Appl. No.: 16/950,283

(22) Filed: Nov. 17, 2020

(65) Prior Publication Data

US 2021/0154699 A1 May 27, 2021

Related U.S. Application Data

(60) Provisional application No. 62/939,391, filed on Nov. 22, 2019.

(51) Int. Cl.

| | |
|---|---|
| ***B05D 5/06*** | (2006.01) |
| ***B05D 5/02*** | (2006.01) |
| ***B05D 5/12*** | (2006.01) |

(52) U.S. Cl.

CPC ..... *B05D 5/066* (2013.01); *B05D 5/02* (2013.01); *B05D 5/12* (2013.01)

(58) Field of Classification Search

CPC ..... B05D 5/066; B05D 5/02; B05D 5/12

See application file for complete search history.

(56) References Cited

U.S. PATENT DOCUMENTS

| | | | | |
|---|---|---|---|---|
| 8,343,268 | B2 | 1/2013 | Ma et al. | |
| 9,000,069 | B1 * | 4/2015 | Mackulin | C08F 20/24 524/502 |
| 9,040,626 | B2 | 5/2015 | Chien et al. | |
| 2004/0127593 | A1 * | 7/2004 | Berkau | B05D 7/16 522/71 |

OTHER PUBLICATIONS

Giles Dillingham and Pierce Geary. What is the Difference between Surface Tension and Surface Energy. https://www.btglabs.com/blog/what-is-the-difference-between-surface-tension-and-surface-energy-1. BTG Labs (Year: 2021).*

* cited by examiner

*Primary Examiner* — Dah-Wei D. Yuan
*Assistant Examiner* — Kristen A Dagenais-Englehart
(74) *Attorney, Agent, or Firm* — Wendy W. Koba

(57) ABSTRACT

A method of creating a bulk product that includes a surface layer of specialized content is based upon the use of an excipient with a different surface tension such that self-differentiating of the excipient from the bulk during drying/curing transports the specialized material to the surface of the bulk product. When the excipient has a lower surface tension than the bulk material, the difference in surface tension causes the low surface tension material to rise to the top surface, bringing the specialized material along. Alternatively, if the excipient has a higher surface tension than the bulk material, it will transport the specialized material to the bottom surface of the product.

6 Claims, 2 Drawing Sheets

FORMATION OF SPECIALIZED COATINGS ON PRODUCTS BASED UPON SELF-DIFFERENTIATING SLURRIES OR LIQUIDS

CROSS-REFERENCE TO RELATED APPLICATIONS

This application claims the benefit of U.S. Provisional Application No. 62/939,391, filed Nov. 22, 2019 and herein incorporated by reference.

TECHNICAL FIELD

The present invention relates to the formation of materials (products) with a specialized coating layer and, in particular, to a method using an excipient that effectuates the transport of a specialized component through the bulk of the material, creating a surface layer of specialized content that self-differentiates from the bulk during drying/curing.

BACKGROUND OF THE INVENTION

Numerous situations arise where it is desirable to modify the properties of a surface region of a material from what is commonly found. For example, printing ink may smear on a printed page surface after exiting an ink-jet printer. It would be desirable to modify the properties of the ink "surface" to minimize this smearing problem. In a completely different situation, there is often a need to add expensive nanomaterials to concrete as it is being prepared, where the nanomaterials are used to modify the exposed surface of the cured cement in some manner. To date, there is no efficient way to add these materials preferentially to the surface as the concrete is poured and thus a given nanomaterial is added to the concrete slurry as it is being prepared. As a result, a significant amount of the nanomaterial ends up residing in the bulk material of the concrete where it is not needed—creating a significant expense and wasting precious material. Various other liquid materials—for example, paint or staining liquids—would benefit by having a surface with specific properties without the need to spend the time and money applying an overcoat.

SUMMARY OF THE INVENTION

These and other problems associated with conventional liquids and slurries is addressed by the present invention, which relates to a method of creating a bulk product that includes a surface layer of specialized content that self-differentiates from the bulk during drying/curing.

In accordance with the principles of the present invention, an "inactive" material (i.e., an excipient) with a surface tension different from that of the base material is used in combination with the specialized material intended to reside at the surface of the finished product. When the excipient has a lower surface tension than the bulk material, the difference in surface tension causes the low surface tension material to travel to the air-surface interface of the bulk material, bringing the specialized material along. Alternatively, if the excipient has a higher surface tension than the bulk material, it will transport the specialized material away from the air-surface interface of the product.

This use of differentiated surface tension is equally applicable to liquids and slurries and finds use in diverse applications, such as those mentioned above.

An exemplary embodiment of the present invention takes the form of a method of creating a specialized coating layer on a product transforming into final form from a liquid/slurry initial stage. The method itself includes the steps of: (1) providing a bulk product material in liquid/slurry form, the bulk product material exhibiting a surface tension $\sigma_{prod}$; (2) selecting a transport liquid that is immiscible with the bulk product material (for example, oil with water), and having a surface tension $\sigma_{liq}$ that is different from $\sigma_{prod}$; (3) dispersing a specialized material component into the transport liquid; and (4) mixing the transport liquid with the bulk product material. The immiscibility and the difference in surface tensions ($\sigma_{prod} \neq \sigma_{liq}$) causes the transport liquid to entrap the specialized material in a plurality of micelles that, in order to minimize the surface tension gradients, move to a surface of the bulk product material during transformation into its final form.

Other and further aspects and advantages of the present invention will become apparent during the course of the following discussion and by reference to the accompanying drawings.

BRIEF DESCRIPTION OF THE DRAWINGS

Referring now to the drawings, where like numerals represent like views.

DETAILED DESCRIPTION

The present invention provides a method of concentrating ("targeting") ingredients to a surface of a liquid/slurry that is independent of the bulk volume of the whole of the forming product material itself. As a result, expenses associated with desiring to form a surface layer of a costly component (e.g., nanomaterials, conductive materials, referred to at times below as "active ingredient") is significantly reduced. In accordance with the principles of the present invention, active ingredients are transported to, or assembled at, a surface of a liquid/slurry as it begins to harden. As will be discussed in detail below, the movement of selected active ingredients occurs by manipulating surface tension gradients.

As is known, liquids that exhibit a relatively low surface tension will "coat" or "wet" liquids having a higher surface tension, in order to minimize surface tension gradients (e.g., a surfactant liquid coating an air-water interface). In accordance with the present invention, therefore, this mechanism is utilized to drive a liquid of lower surface tension (that has been treated to include the specialized material, as described below) to coat the surface of a higher surface tension liquid that comprises the bulk of the material being used. The alternative is also possible, with a liquid having a significantly higher surface tension traveling away from the air-surface interface of the bulk material, concentrating specialized material towards another, second surface.

Figure 1:
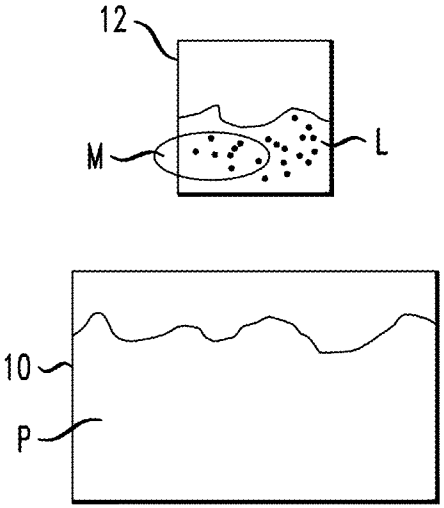
FIGS. 1-4 illustrate an exemplary set of steps outlining a self-differentiating process in accordance with the present invention.

FIGS. 1-4 contain a set of simplified block diagrams illustrating the process of using surface tension self-differentiating to form a surface coating of specialized material as a bulk material hardens/cures. FIG. 1 illustrates a large-sized container 10 of a liquid/slurry product P with a known surface tension $\sigma_{prod}$. As discussed above, product P comprises a liquid or slurry, ranging across a wide variety of possibilities (e.g., concrete, printing ink, and paint being a few product possibilities, as suggested above). A small-sized container 20 is also shown in FIG. 1, and contains a liquid L with a surface tension $\sigma_{liq}$ that in this example is less than that of product P (i.e., $\sigma_{liq}<\sigma_{prod}$). Known liquids with a relatively low surface tension include silicone "oils", such as an ethoxysilane.

A specialized material M selected to form a particular coating on the surface of product P when it cures is dispersed into liquid L, as shown in FIG. 1. This specialized material M may be thought of as the "payload" to be transported to the surface during the drying/curing process. Specialized materials that typically find use as coatings include, but are not limited to, nano-sized silver, carbide, pigment, photocatalysts, and the like.

Figure 2:
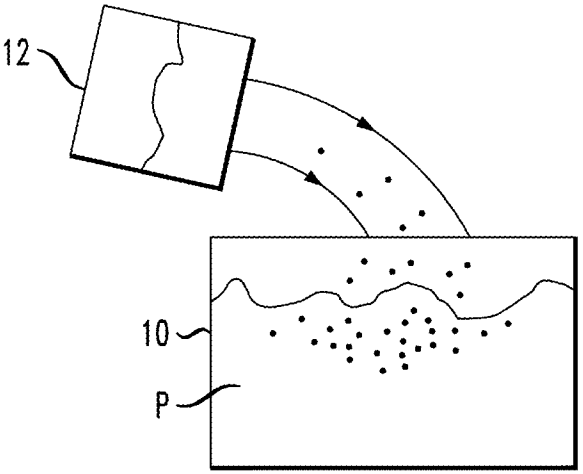
Figure 3:
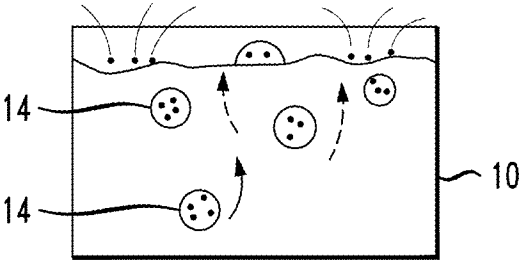
Figure 4:
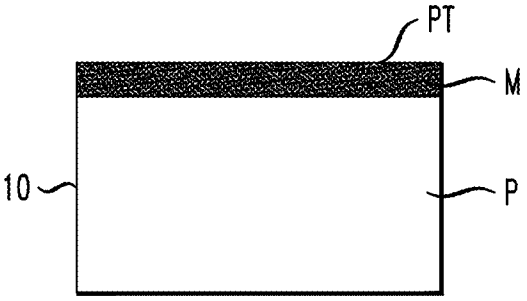

The next step in the process, as shown in FIG. 2, is to blend liquid L (with the dispersion of material M) with the initial, liquid form of product P. As the two mix, as long as the specialized material-enhanced liquid L is not miscible, it will form a dispersion of micelles 14 within product P, as shown in FIG. 3. Micelles 14 function to trap volumes of specialized material M (in the same manner, for example, as droplets of fat in milk), where the difference in surface tension between product P and liquid L ($\sigma_{liq}<\sigma_{prod}$) results in micelles 14 becoming transport vehicles that bring specialized material M to the surface of product P. Therefore, in accordance with the principles of the present invention, the self-differentiating occurring as a result of the difference in surface tension between product P and liquid L functions to "automatically" coat product P with specialized material M without requiring any additional fabrication processes. Micelles 14 fuse upon reaching the air-product interface, releasing the payload of the specialized material M. The final formation is shown in FIG. 4, where top surface PT of product P incorporates the specialized material M that has been transported during the process.

Figure 5:
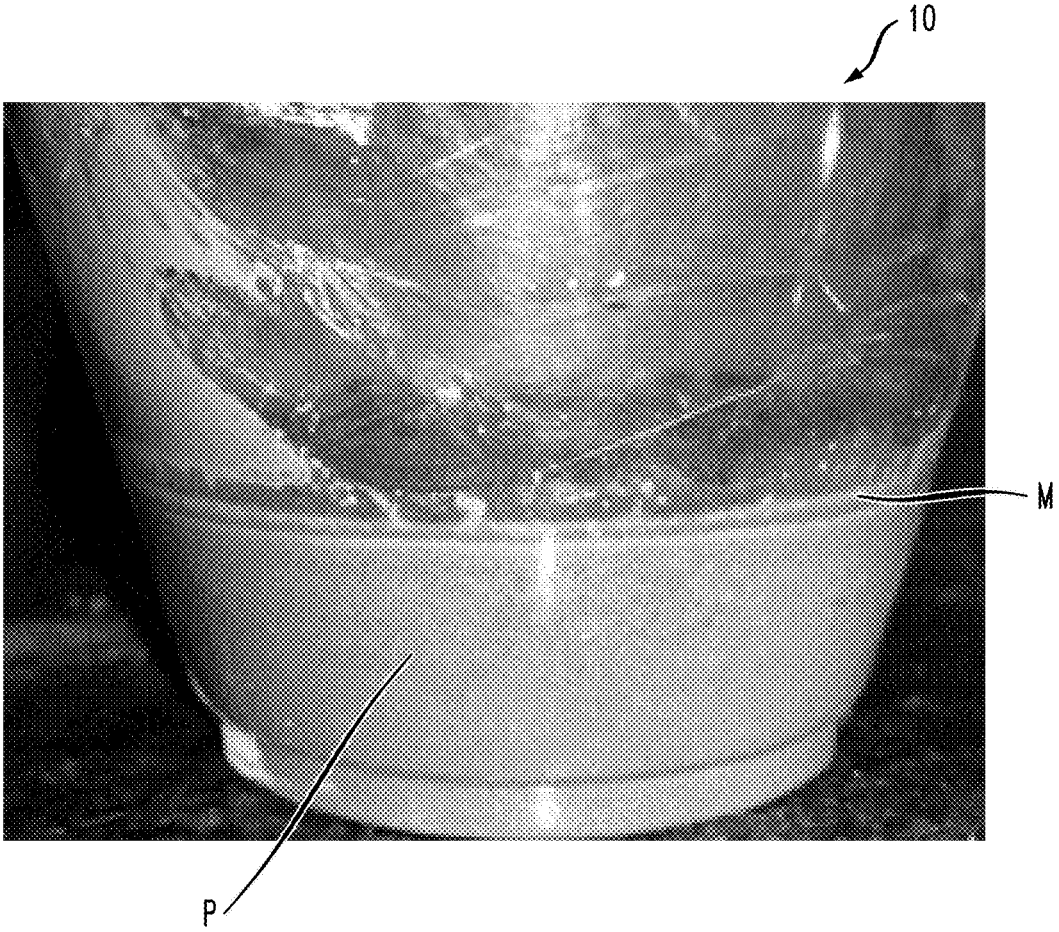
FIG. 5 is a reproduction of a photograph illustrating a self-differentiated concrete including a surface layer of a specialized composition.

FIG. 5 is a reproduction of a photograph of a cured concrete product that includes a surface layer with specialized properties, the transporting low surface tension liquid including pigmentation to clearly illustrate the differentiation that occurs.

In an exemplary embodiment, a silicone oil loaded with an antimicrobial nanomaterial may comprise the low surface tension liquid L, with a paper slurry comprising the "product" P to be formed. After introducing the nanomaterial-including liquid into the paper slurry, the same process occurs as described above, with the silicone oil forming micelles within the paper slurry, entrapping small volumes of the antimicrobial nanomaterial that will rise to the surface of the paper slurry as the paper dries out. The presence of the silicone leaves the surface of the paper antimicrobial and more water resistant, with little effect on the bulk properties of the paper.

Indeed, in accordance with the principles of the present invention, the use of surface tension self-differentiation allows the characteristics of a product's surface to be tailored independently of the characteristics of the bulk of the product itself. The self-differentiation can be effectuated by using an excipient with a surface tension less than that of the liquid form of the bulk material (creating a first-surface coating), or using an excipient with a surface tension greater than that of the liquid form of the bulk material (creating a second-surface coating). And while the above has described self-differentiation between two liquids/slurries, it is to be understood that multiple components of different surface tensions may be employed and used to form a multi-layered product with each layer having its own distinct characteristics and properties.

Summarizing, the disclosed method may be used in a nanotechnology-based admixture, which includes an excipient that automatically travels to a liquid/air interface as the liquid itself is hardening (curing, drying). The excipient transports (carries) many desired types of materials (including, for example, nanoparticles) so as to concentrate these materials at the surface, instead of leaving them uselessly in the bulk.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. One skilled in the art will further appreciate that the invention may be used with many modifications of structure, arrangement, proportions sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention. All patents and published patent applications identified herein are incorporated herein by reference in their entireties.

What is claimed is:

1. A method of creating a specialized coating layer on a product transforming into final solid form from a liquid/slurry initial stage, comprising the steps of:

a) providing a bulk product material in liquid/slurry form, the bulk product material exhibiting a surface tension $\sigma_{prod}$;

b) selecting a transport liquid with a surface tension $\sigma_{liq}$ that is different from $\sigma_{prod}$;

c) dispersing a specialized material component into the transport liquid;

d) mixing the transport liquid with the dispersion of the specialized material created in step c) with the bulk product material provided in step a), wherein the difference in surface tensions ($\sigma_{prod}\neq\sigma_{liq}$) causes the transport liquid to entrap the specialized material in a plurality of micelles that move the specialized material to a surface of the bulk product material during transformation into its final solid form; and e) releasing the specialized material from the plurality of micelles upon reaching the surface of the bulk product material.

2. The method as defined in claim 1 wherein the transport liquid exhibits a surface tension $\sigma_{liq}$ that is less than the surface tension $\sigma_{prod}$ of the bulk product material ($\sigma_{liq}<\sigma_{prod}$), such that the difference in surface tension transports the plurality of micelles entrapping the specialized material to a top surface of the bulk product material, forming a top surface coating.

3. The method as defined in claim 2 wherein in performing step b), selecting a transport liquid that is immiscible with the provided bulk product material.

4. The method as defined in claim 1 wherein the transport liquid exhibits a surface tension $\sigma_{liq}$ greater than the surface tension $\sigma_{prod}$ of the bulk product material ($\sigma_{liq}>\sigma_{prod}$), such that the plurality of micelles transport the specialized material to another surface of the bulk product material, forming a second surface coating.

5. The method as defined in claim 1 wherein the method further comprises the steps of:

e) prior to performing step d), selecting a second transport liquid with a surface tension $\sigma_{liq2}$ that is different from both $\sigma_{liq}$ and $\sigma_{prod}$;

f) dispersing a second specialized material component into the second transport liquid; and substantially simultaneously with step d), g) mixing the second transport liquid with the dispersion of the second specialized material created in step f) with the bulk product material provided in step a), wherein the differences in all surface tensions ($\sigma_{prod}\neq\sigma_{liq}\neq\sigma_{liq2}$) causes the first and second transport liquids to entrap their respective specialized materials in first and second pluralities of micelles, respectively, that move to form layers between the bulk product material and its surface during transformation into its final solid form.

6. The method as defined in claim 1 wherein the specialized material provides changes in a property selected from the group consisting of: conductivity, hardness, resistance to wear, photoactivity, antimicrobial effects, permeability to water, color, and texture.

* * * * *